US006926586B2

(12) United States Patent
Han

(10) Patent No.: US 6,926,586 B2
(45) Date of Patent: Aug. 9, 2005

(54) FIXTURE FOR ATTACHING INDICATOR TO GRINDING MACHINE

(75) Inventor: Dong Han, Shenzhen (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/807,212

(22) Filed: Mar. 22, 2004

(65) Prior Publication Data

US 2004/0185752 A1 Sep. 23, 2004

(30) Foreign Application Priority Data

Mar. 21, 2003 (TW) ..... 92204451 U

(51) Int. Cl.[7] ..... B24B 49/00
(52) U.S. Cl. ..... 451/8; 451/11
(58) Field of Search ..... 451/8, 9, 10, 11, 451/369, 410, 460

(56) References Cited

U.S. PATENT DOCUMENTS

| | | | | | |
|---|---|---|---|---|---|
| 2,462,997 | A | * | 3/1949 | Roush | 409/144 |
| 3,822,512 | A | * | 7/1974 | Mercer, Jr. | 451/15 |
| 3,862,517 | A | * | 1/1975 | Porter, Jr. | 451/28 |
| 4,096,667 | A | | 6/1978 | Uhtenwoldt et al. | |
| 4,170,851 | A | | 10/1979 | Enos | |
| 4,811,525 | A | * | 3/1989 | Kimura et al. | 451/361 |

* cited by examiner

*Primary Examiner*—Dung Van Nguyen
(74) *Attorney, Agent, or Firm*—Wei Te Chung

(57) ABSTRACT

A fixture includes a fixing member attached to a grinding machine (10), a guiding shaft (37) attached to the fixing member and a clamp (38). The clamp defines a pair of holes (381, 382) in opposite ends thereof, for movably receiving the guiding shaft and an indicator (20) therein respectively. When the shaft and indicator are loosened from the holes of the clamp respectively, the clamp is rotated about the guiding shaft toward a workpiece (19) on the grinding machine, and the indicator is adjusted with respect to the workpiece, for measuring of the workpiece.

18 Claims, 3 Drawing Sheets

FIXTURE FOR ATTACHING INDICATOR TO GRINDING MACHINE

BACKGROUND OF THE INVENTION

1. Field of the Invention

The present invention relates to a fixture, and more particularly to a fixture for a surface grinding machine.

2. Description of the Related Art

Generally, when a surface grinding machine grinds a workpiece, a precise desired dimension of the workpiece can not be automatically achieved. This is because of abrasive wear of a grinding wheel of the grinding machine, and thermal expansion of the grinding wheel. To overcome the problem, a skilled worker has to measure the workpiece time and again, and alter a feed value of the grinding wheel accordingly to obtain the desired dimension. To obtain each measurement, the worker typically removes the workpiece from the grinding machine, and takes it to a measuring table for measuring with a gage. However, it is laborious and inefficient to repeatedly move the workpiece between the surface grinding machine and the measuring table.

SUMMARY OF THE INVENTION

Accordingly, an object of the present invention is to provide a fixture which attaches an indicator to a grinding machine.

Another object of the present invention is provide a grinding machine that facilitates measurement of a workpiece.

To achieve the above objects, a fixture in accordance with the present invention comprises a fixing member, a guiding shaft and a clamp. The fixing member comprises an annular bracket and a T-shaped bracket attached to the annular bracket. The annular bracket is attached to a grinding machine. The guiding shaft is attached to the T-shaped bracket. The clamp defines a pair of holes in opposite ends thereof respectively. One of the holes movably receives the guiding shaft therein, and the other of the holes movably receives an indicator therein. Each hole communicates with a respective end slot. A pair of parallel first ears extends outwardly from one of the ends of the clamp, thereby defining one of the end slots. A pair of parallel second ears extends outwardly from the other end of the clamp, thereby defining the other end slot. A pair of fasteners such as screws is engaged through the first and second ears respectively, for tightening and loosening the first and second ears. The indicator is thereby attached to the grinding machine with the fixture. When the guiding shaft and indicator are loosened from the holes of the clamp respectively, the indicator is adjusted with respect to the workpiece, for measuring of the workpiece.

Other objects, advantages and novel features of the present invention will be drawn from the following detailed description of preferred embodiments of the present invention with the attached drawings, in which:

DESCRIPTION OF THE PREFERRED EMBODIMENT

Figure 1:
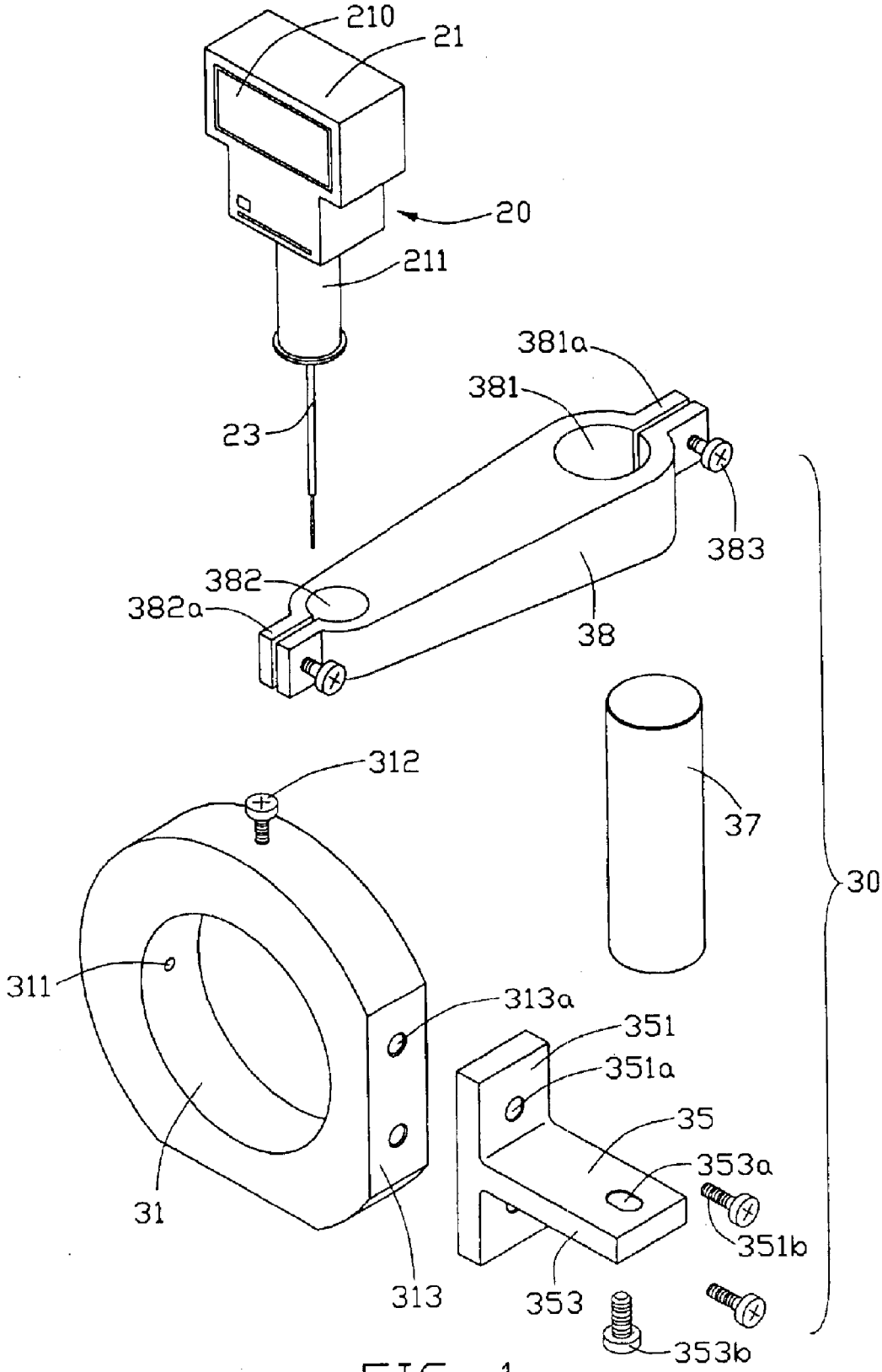
FIG. 1 is an exploded, isometric view of a fixture in accordance with a preferred embodiment of the present invention, together with a gage.
Figure 2:
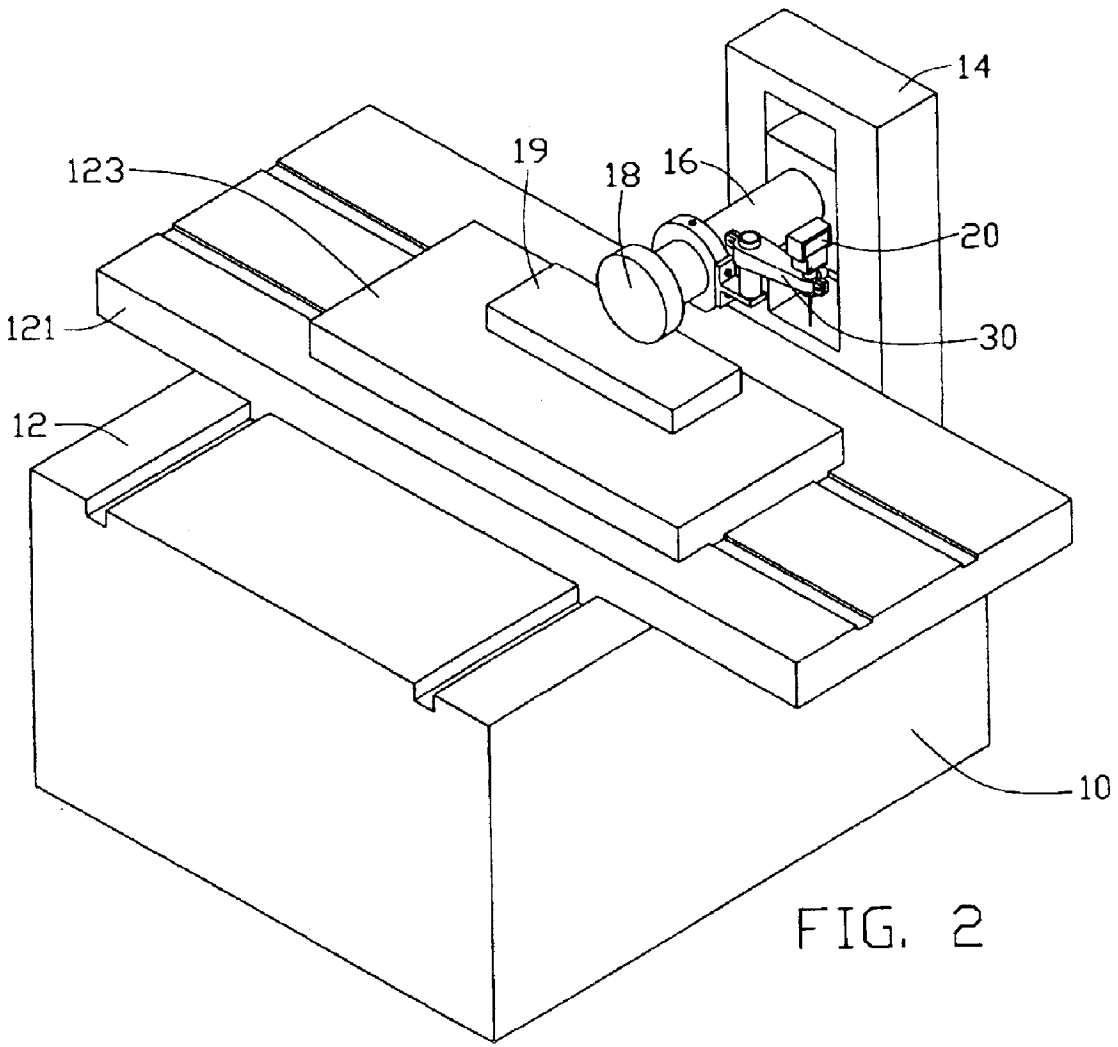
FIG. 2 is an isometric view of a grinding machine incorporating the fixture and the gage of FIG. 1 fully assembled, showing the fixture in a first position.
Figure 3:
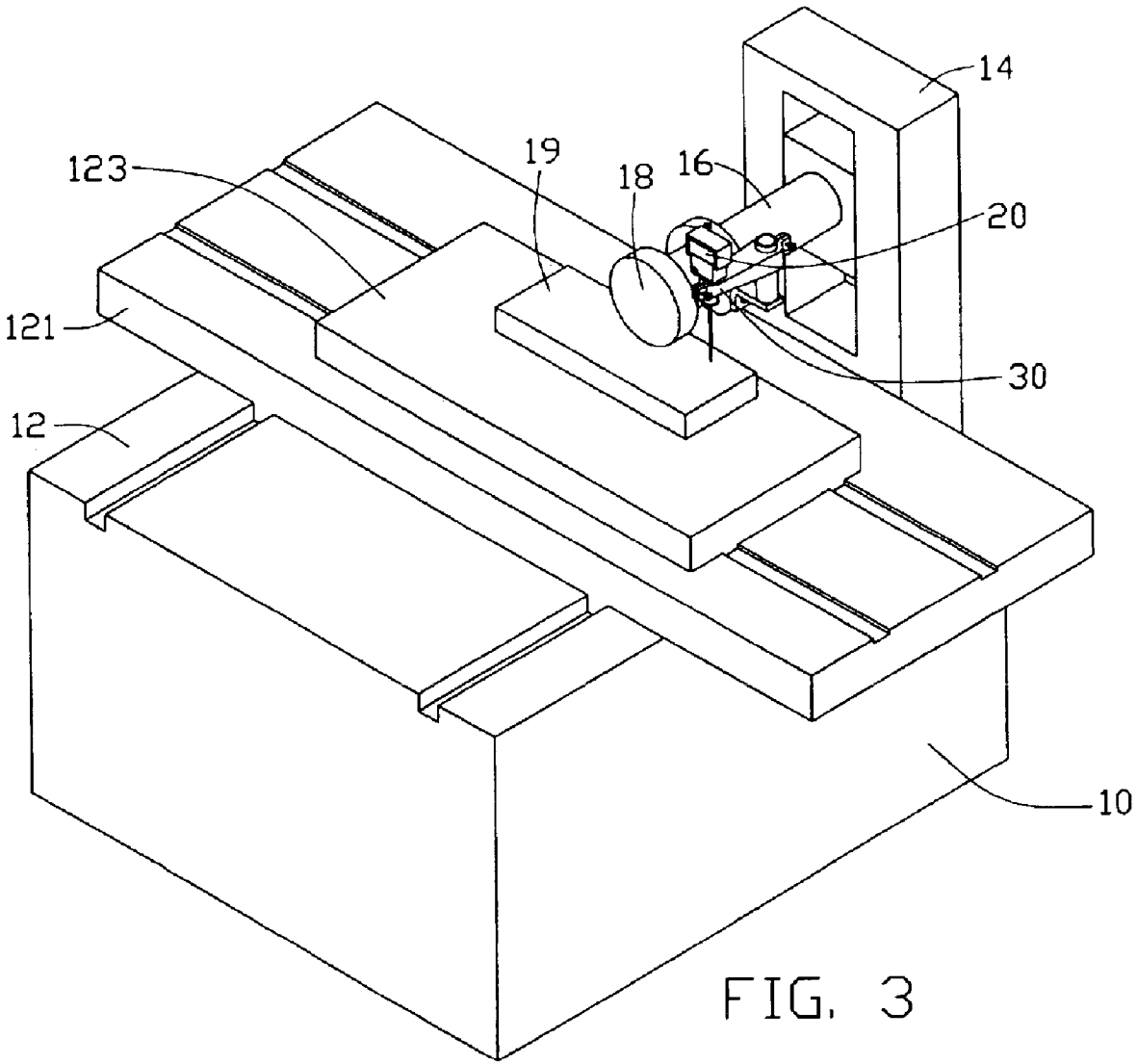
FIG. 3 is similar to FIG. 2, but showing the fixture in a second position.

Referring to FIGS. 1 to 3, a fixture 30 in accordance with the preferred embodiment of the present invention is provided to attach an indicator 20, such as a depth gage, to a grinding machine 10.

The grinding machine 10 comprises a base 12, and an upright column 14 extending upwardly from the base 12. A first table 121 is provided on the base 12, and is slidable on a top of the base 12 along a first axis. A second table 123 is provided on the first table 121. The second table 123 is slidable on a top of the first table 121 along a second axis perpendicular to the first axis, in cooperation with sliding of the first table 121. A working head is slidably attached in the column 14, and moves up and down along a third axis that is perpendicular to both the first and second axes. The working head comprises a sleeve 16 extending perpendicularly forwardly with respect to the column 14. The sleeve 16 incorporates a spindle (not shown) therein. A rotatable grinding wheel 18 is mounted to a free end of the spindle, for grinding a workpiece 19 that is securely fixed on the second table 123 by a magnetic chuck (not shown).

In the preferred embodiment of the present invention, the indicator 20 is an electronic digital indicator. However, as one skilled in the art will appreciate, the indicator 20 may alternatively be another kind of indicator such as a mechanical indicator. The indicator 20 comprises a body 21 having a display 210 indicating a numerical dimension. A probe 23 depends from a cylinder 211 of the body 21, for contacting the workpiece 19. The probe 23 is retractable into the cylinder 211.

The fixture 30 comprises a fixing member, a guiding shaft 37, and a clamp 38.

The fixing member comprises an annular bracket 31, and a T-shaped bracket 35. A plurality of through holes 311 is defined in the annular bracket 31. A plurality of screws 312 is provided for extension through the through holes 311 and thereby attaching the annular bracket 31 to the sleeve 16. A planar portion 313 is formed on a circumferential surface of the annular bracket 31. A pair of spaced threaded holes 313*a* is defined in the planar portion 313. The T-shaped bracket 35 comprises a vertical plate 351, and a horizontal plate 353 extending perpendicularly from a middle portion of the vertical plate 351. A pair of through holes 351*a* is defined in the vertical plate 351 at opposite sides of the horizontal plate 353 respectively, corresponding to the threaded holes 313*a* of the annual bracket 31. A pair of fasteners such as screws 351*b* is provided for inserting through the through holes 351*a* and engaging in the threaded holes 313*a*, thereby joining the T-shaped bracket 35 and the annual bracket 31 together. A slot 353*a* is defined in a free end of the horizontal plate 53 of the T-shaped bracket 35. A threaded hole (not visible) is defined in a bottom of the guiding shaft 37. A screw 353*b* is for extending through the slot 353*a* to engage in the threaded hole of the guiding shaft 37, thereby fixing the guiding shaft 37 to the T-shaped plate 35.

The clamp 38 defines a pair of holes 382, 381 in opposite ends thereof respectively, corresponding to the cylinder 211 of the indicator 20 and the guiding shaft 37 respectively. Each hole 381, 382 communicates with a respective end slot (not labeled). A pair of parallel first ears 381*a* extends outwardly from one of the ends of the clamp 38, thereby defining one of the end slots. A pair of parallel second ears

382*a* extends outwardly from the other end of the clamp 38, thereby defining the other end slot. A pair of fasteners such as screws 383 is provided to tighten or loosen the first and second ears 381*a*, 382*a* respectively.

In use, the annular bracket 31 of the fixture 30 is mounted on the sleeve 16 of the grinding machine 10. The annular bracket 31 embraces the sleeve 16 therein, and the screws 312 are extended through the through holes 311 of the annual bracket 31 to securely attach the annular bracket 31 to the sleeve 16. The T-shaped bracket 35 is attached to the planar portion 313 of the annular bracket 31 by the screws 351*b*. The guiding shaft 37 is fastened on the horizontal plate 353 of the T-shaped bracket 35 by the screw 353*b*. The hole 381 of the clamp 38 slidably receives a free end of the guiding shaft 37 therein. One of the screws 383 is used to tighten the first ears 381*a* together, thereby tightly clasping the guiding shaft 37 in the hole 381. The hole 382 of the clamp 38 clasps the cylinder 211 of the indicator 20 therein. The other screw 383 is used to tighten the second ears 382*a* together, thereby tightly clasping the cylinder 211 in the hole 382. The indicator 21 is thus attached to the grinding machine 10 through the fixture 30.

FIG. 2 shows the indicator 20 in the first position, in which the indicator 20 is positioned far from the workpiece 19 in order to not interfere with the grinding wheel 18 grinding the workpiece 19. After the grinding wheel 18 is removed from the workpiece 19, the screw 383 at the first ears 381*a* of the clamp 38 is loosened, and the clamp 38 is rotated about the guiding shaft 37 toward the workpiece 19. If desired, the screw 383 at the second ears 382*a* is loosened to allow the cylinder 211 of the indicator 21 to be moved in the hole 382 of the clamp 38. This enables easy adjusting of the indicator 21 with respect to the workpiece 19. FIG. 3 shows the indicator 20 in the second position, in which the probe 23 of the indicator 21 contacts the workpiece 19, and the display 210 indicates a numerical dimension of the workpiece 19.

The indicator 20 attached to the grinding machine 10 obviates the need for a worker to shift the workpiece 19 between the grinding machine 10 and a measuring table. This greatly increases the efficiency with which the workpiece 19 is handled and processed.

While the present invention has been illustrated by the description of the preferred embodiment thereof, and while the preferred embodiment has been described in considerable detail, it is not intended to restrict or in any way limit the scope of the appended claims to such detail. Additional advantages and modifications within the spirit and scope of the present invention will readily appear to those skilled in the art. Therefore, the present invention is not limited to the specific details and illustrative examples shown and described.

What is claimed is:

1. A fixture for attaching an indicator to a grinding machine, the grinding machine comprising a sleeve, the fixture comprising:

a fixing member being adapted to be attached to the sleeve;

a shaft being connected to the fixing member; and a clamp defining a pair of holes in opposite ends thereof, wherein one hole slidably and rotatably receives the shaft therein, and the other hole is adapted for movably receiving the indicator therein.

2. The fixture as claimed in claim 1, wherein the fixing member comprises an annular bracket adapted for receiving the sleeve of the grinding machine, and a T-shaped bracket fixedly attached to the shaft.

3. The fixture as claimed in claim 2, wherein a plurality of through holes is defined in the annular bracket, and a plurality of fasteners is provided corresponding to the through holes and being adapted for fixedly attaching the annular bracket to the sleeve.

4. The fixture as claimed in claim 2, wherein the annular bracket defines a planar portion, the T-shaped bracket comprises a vertical plate in alignment with the planar portion of the annular bracket, and the T-shaped bracket further comprises a horizontal plate extending perpendicularly from a central portion of the vertical plate.

5. The fixture as claimed in claim 4, wherein a pair of threaded holes is defined in the planar portion of the annular bracket, a pair of through holes is defined in the vertical plate of the T-shaped bracket at opposite sides of the horizontal plate, and a pair of fasteners extends through the through holes of the T-shaped bracket and engages in the threaded holes respectively.

6. The fixture as claimed in claim 5, wherein the horizontal plate of the T-shaped bracket defines a slot in a free end thereof, and a fastener is provided corresponding to the slot for attaching the shaft to the horizontal plate.

7. The fixture as claimed in claim 1, wherein the clamp defines a pair of slots communicating with the holes thereof, a pair of first ears extends from one of the ends of the clamp thereby defining one of the slots therebetween, a pair of second ears extends from the other end of the clamp thereby defining the other slot therebetween, and a pair of fasteners is engaged through the first and second ears respectively for tightening and loosening of the first and second ears.

8. A grinding machine comprising:

a base;

at least one table movable with respect to the base, for supporting a workpiece thereon;

a sleeve being suspended over the base, wherein a grinding wheel is provided in front of the sleeve;

an indicator; and a fixture comprising a fixing member, a shaft and a clamp, wherein the fixing member is attached to the sleeve, the shaft is attached to the fixing member, the clamp is pivotably attached to the shaft, and the indicator is movably attached to the clamp for indicating a dimension of the workpiece.

9. The grinding machine as claimed in claim 8, further comprising a spindle being received in the sleeve, with the grinding wheel being arranged on a free end of the spindle.

10. The grinding machine as claimed in claim 8, wherein the fixing member comprises an annular bracket attached to the sleeve, and a T-shaped bracket connected to the annular bracket and the shaft.

11. The grinding machine as claimed in claim 8, wherein the clamp defines a pair of holes in opposite ends thereof, one hole slidably and rotatably receives the shaft therein, and the other hole movably receives the indicator therein.

12. The grinding machine as claimed in claim 11, wherein the clamp defines a pair of slots communicating with the holes respectively, a pair of first ears extends from one of the ends of the clamp thereby defining one of the slots, a pair of second ears extends from the other end of the clamp thereby defining the other slot, and a pair of fasteners is engaged through the first and second ears respectively for tightening and loosening of the first and second ears.

13. A grinding machine comprising:

a base;

a column extending upwardly from the base;

at least one table movable with respect to the base in a first direction, for supporting a workpiece thereon;

a sleeve with an grinding wheel movably in engagement with the column in a second direction perpendicular to the first direction, for grinding the workpiece; and an indicator associated with the sleeve, wherein the indicator is rotated toward the at least one table for measuring a dimension of the workpiece when the grinding wheel is removed from the workpiece, and the indicator is rotated away from the at least one table for not interfering with the grinding wheel grinding the workpiece.

14. The grinding machine as claimed in claim 13, wherein the indicator is attached to the sleeve via a fixture.

15. The grinding machine as claimed in claim 14, wherein the fixture comprises a fixing member, a shaft and a clamp, wherein the fixing member is attached to the sleeve, the shaft is attached to the fixing member, the clamp is pivotably attached to the shaft, and the indicator is movably attached to the clamp.

16. The grinding machine as claimed in claim 15, wherein the fixing member comprises an annular bracket attached to the sleeve, and a T-shaped bracket connected to the annular bracket and the shaft.

17. The grinding machine as claimed in claim 15, wherein the clamp defines a pair of holes in opposite ends thereof, one hole slidably and rotatably receives the shaft therein, and the other hole movably receives the indicator therein.

18. The grinding machine as claimed in claim 17, wherein the clamp defines a pair of slots communicating with the holes respectively, a pair of first ears extends from one of the ends of the clamp thereby defining one of the slots, a pair of second ears extends from the other end of the clamp thereby defining the other slot, and a pair of fasteners is engaged through the first and second ears respectively for tightening and loosening of the first and second ears.

* * * * *